United States Patent [19]

Cescon et al.

[11] Patent Number: 4,619,721

[45] Date of Patent: Oct. 28, 1986

[54] EMULSION-CONTAINING EXPLOSIVE COMPOSITIONS

[75] Inventors: Lawrence A. Cescon, Portogruaro, Italy; Robert W. Trebilcock, Littleton, Colo.

[73] Assignee: E. I. Du Pont de Nemours and Company, Wilmington, Del.

[21] Appl. No.: 787,442

[22] Filed: Oct. 15, 1985

[51] Int. Cl.[4] ..... C06B 45/02

[52] U.S. Cl. ..... 149/21; 149/2; 149/46; 149/61; 149/76; 149/83; 149/112; 149/113; 149/109.6

[58] Field of Search ..... 149/2, 21, 112, 113, 149/46, 61, 76, 83, 109.6

[56] References Cited

U.S. PATENT DOCUMENTS 4,409,044 10/1983 Bhattacharyya et al. ..... 149/60

*Primary Examiner*—Stephen J. Lechert, Jr.

*Attorney, Agent, or Firm*—Diamond C. Ascani

[57] ABSTRACT

In emulsion blend explosives, the replacement of coarse salt particles, e.g., prills, by fines, i.e., particles which pass a No. 50 U.S. sieve, increases the water resistance of the explosive without deleteriously affecting its shelf life provided that the explosive, prior to such replacement, is storage-stable as determined by the Salt Extraction and lead compression tests described herein. Products containing a combination of whole and crushed ammonium nitrate prills, and emulsions made with an anionic emulsifying agent such as a fatty acid salt, are preferred. Depending on the fines content and chemical composition, other properties such as sensitivity to initiation and detonation velocity also may be improved.

27 Claims, No Drawings

EMULSION-CONTAINING EXPLOSIVE COMPOSITIONS

BACKGROUND OF THE INVENTION

1. Field of the Invention

The present invention relates to explosive compositions comprising a sensitized blend of a water-in-oil emulsion and solid particulate inorganic oxidizing salt, preferably ammonium nitrate (AN).

2. Description of the Prior Art

Explosives which comprise a blend of a water-in-oil emulsion and solid particulate AN, e.g., ANFO (AN prills coated with fuel oil), are becoming increasingly popular with blasters owing to the fact that they are able to offer the advantages of high bulk density and blasting energy characteristic of emulsion explosives, while at the same time resulting in cost reductions owing to the lower cost of the AN. In some instances, however, these blend explosive produces, referred to herein as "emulsion blend explosives", have been found to have a short shelf life, requiring the use of the products immediately after they have been formed. "Short shelf life" means that an explosive product lacks stability, undergoing deleterious changes(s) in structure and/or composition to the degree that it cannot be depended upon to detonate at the required velocity at the required time. If the product's shelf life is very short, it almost certainly is unsuitable for use in packaged form, and can be unsuitable for use in bulk form, especially if it needs to be transported to the place of use or allowed to stand in a borehole for some time after loading.

U.S. Pat. No. 4,555,278, issued Nov. 26, 1985, to L. A. Cescon and N. J. Millet, Jr., describes the formation of emulsion blend explosives having improved storage stability. This application states that in these explosives, the blend-destabilizing transport or loss of water from the emulsion's aqueous dispersed phase across the continuous oil phase to the admixed nitrate particles is minimized by virtue of a barrier or medium, resistive to water-transport, formed preferably by the continuous emulsion phase itself, e.g., by the presence of an anionic emulsifying system comprising a fatty acid salt and a free fatty acid, the latter in solution in an oil as the continuous emulsion phase. The same patent application further states that a water-transport-resistive barrier also can be provided, for example, by a low-diffusivity (to water) coating on the nitrate particles.

One of the materials which is commonly employed as the particulate solid component of emulsion blend explosives in ANFO. While ANFO is a popular blasting product in its own right because of economy and convenience, its lack of water resistance and low product density are well-recognized as product deficiencies. The blending of ANFO with a water-in-oil emulsion results in a product of higher density, and a certain degree of water resistance may be achieved in the blend product, especially if the emulsion/solids weight ratio is high. Thus, some unpackaged emulsion blend products can be used in wet boreholes. Nevertheless, even those emulsion blend explosives which are storage-stable could be utilized in a more economic manner, i.e., in bulk form with formulations of high solids content, if their water resistance could be improved.

SUMMARY OF THE INVENTION

The present invention provides an improvement in an emulsion blend explosive which comprises a sensitized blend of inorganic oxidizing salt particles and a water-in-oil emulsion comprising a carbonaceous fuel having components which form a continuous emulsion phase, an aqueous solution of an inorganic oxidizing salt forming a discontinuous emulsion phase dispersed as discrete droplets within the continuous phase, and an emulsifying agent. More particularly, the improvement provided by this invention applies to a storage-stable blend of the type described above and comprises, in said blend, inorganic oxidizing salt particles containing at least about 15, and preferably at least about 20, percent by weight of a component comprised of particles which are smaller than 297 micrometers, i.e., pass a No. 50 sieve (U.S. series), which has a 0.297 mm sieve opening, the weight ratio of the emulsion to the total inorganic oxidizing salt particles being in the range of about from 20/80 to 70/30.

The particulate oxidizing salt component which consists of particles smaller than 297 micrometers is referred to herein as "fines" or a "fines component". This fines component may constitute the entire particulate oxidizing salt portion of the emulsion blend explosive, i.e., 100 percent by weight of the oxidizing salt particles is composed of fines. However, in an alternative, and in many instances preferred, embodiment, the fines component is present together with coarser particles, preferably with a coarse component containing particles which are larger than 420 micrometers, i.e., are retained on a No. 40 sieve (U.S. series), which has a 0.420 mm sieve opening. Preferably, the coarse component contains AN or ANFO prills.

One of the beneficial effects of a fines component in the particulate oxidizing salt portion of emulsion blend explosives is increased water resistance (i.e., the explosive's resistance to attack by outside water), thereby making the explosive suitable for use in unpackaged form in wet boreholes. This increased water resistance results with those blend explosives which characteristically have a sufficiently long shelf life as to be storable, e.g., products described in the aforementioned U.S. Pat. No. 4,555,278. In these storable products, the solid oxidizing salt is less vulnerable to attack by internal or external water by virtue of a water-transport-resistive medium or barrier which may be the emulsion's continuous phase per se. Provided that the stability of a blend product is protected by this barrier or medium, fines may be substituted for some or all of the solid inorganic oxidizing salt in the blend with essentially no decrease in the blend's shelf life. In the normal situation, the higher-surface-area fines would be expected to have greater attraction for the water in the emulsion's discontinuous phase, causing the blend to become destabilized. As will be discussed hereinafter, the finding that fines can be added to shelf-stable emulsion blends without deleteriously affecting their shelf life is important in several respects, including the aforementioned increase in the blends' water resistance.

The term "storage-stable emulsion blend explosive", as used herein in reference to a product containing all-coarse (i.e., larger than 420 micrometers) particulate inorganic oxidizing salt which is able to maintain its stability when some or all of the coarse particles are replaced by fines, denotes a blend made from such all-coarse particulate salt and a "storage-stable emulsion". A "storage-stable emulsion", as the term is used herein, is one which, when blended at 3000–3500 poise viscosity with AN blasting prills in a 50/50 weight ratio, results in a lead compression of the blend of at least 3.8 centimeters on initiation with a 40-g initiator after blend storage for a period of 7 days, as determined by the lead compression test described herein. Any emulsion which gives this result in the described 50/50 blend is "storage-stable" and gives a blend which is termed "storage-stable" herein with any all-coarse particulate inorganic oxidizing salt in the 20/80 to 70/30 emulsion/salt range.

Another way of identifying a storage-stable emulsion and a storage-stable emulsion blend, in the sense that the terms are used herein, is to make a 50/50 blend of the emulsion at 3000–3500 poise viscosity with AN blasting prills and to subject the blend to the Salt Extraction Test described herein. This test measures the amount of inorganic oxidizing salt extracted from a blend by water, this amount being expressed as a percentage of the total solid and dissolved salt in the blend. Although the percent salt extraction can be expected to increase as the emulsion content of emulsion blends decreases, the expression "storage-stable", in terms of a blend's behavior on fines inclusion, applies herein to blends containing less than 50 percent emulsion by weight (down to about 20 percent), as well as to those containing more (up to about 70 percent), and to blends made with any coarse particulate inorganic oxidizing salt, provided that a salt extraction test performed on a 50/50 blend of the same emulsion and AN prills results in a salt extraction not in excess of about 7 percent.

DETAILED DESCRIPTION

The emulsion blend product of the invention is sensitized, i.e., it contains sufficient sensitizer, e.g., dispersed gas bubbles or voids, as to render it detonable by means customarily used to initiate explosives. This sensitization can be accomplished in any convenient manner. For example, the pre-blended emulsion can per se be fully sensitized, i.e., it can be an explosive emulsion, for example by incorporating dispersed air therein, if desired in the form of air-carrying solid materials such as phenol-formaldehyde microballoons, glass microballoons, fly ash, etc. Alternatively, chemical sensitizers, e.g., amine nitrates such as monomethylamine nitrate, trinitrotoluene, perchlorates, etc., can be incorporated into the emulsion. Also, air-carrying solid materials may be added to the emulsion at the time of blending, and, in fact, porous inorganic nitrate prills may themselves serve as air carriers capable by themselves of sensitizing the blend if present in sufficient amount, generally about 30 percent or more of the blend by weight. Furthermore, the fines themselves may act as a sensitizing constituent of the blend, either in combination with one or more additional sensitizers, or even as essentially the sole sensitizer (see Examples 20–22).

Oils and aqueous inorganic oxidizing salt solutions known to the explosive emulsion art may be employed in the emulsion portion of the blend products, e.g., oils and salt solutions disclosed in U.S. Pat. No. 4,287,010, the disclosure of which patent is incorporated herein by reference. Most often, the inorganic oxidizing salt present in the emulsion's aqueous phase will be an ammonium, alkali metal, or alkaline-earth metal nitrate or perchlorate, preferably ammonium nitrate, alone or in combination with, for example, up to about 50 percent sodium nitrate (based on the total weight of inorganic oxidizing salts in the aqueous phase). Salts having monovalent cations are preferred if the emulsifying agent used is a combination of a fatty acid salt and a fatty acid, as is explained in the aforementioned U.S. Pat. No. 4,287,010. Suitable oils for use in the carbonaceous fuel include fuel oils and lube oils of heavy aromatic, naphthenic, or paraffinic stock, mineral oil, dewaxed oil, etc.

The oil content of the emulsion may be sufficient to provide a substantially oxygen-balanced emulsion, or it may contain excess oil (and be oxidizer-deficient), if it is to be blended with fuel-deficient or fuel-free solid particulate inorganic oxidizing salt. The benefits which may be derived from using such a "high oil" emulsion are described in the aforementioned U.S. Pat. No. 4,555,278, the disclosure of which is incorporated herein by reference.

In addition to the possible inclusion of chemical sensitizers (see above) in the emulsion, e.g., in solution in the discontinuous aqueous phase thereof or as a dispersion of a finely divided solid therein, one or more detonation catalysts such as ammonium dichromate, cupric chloride, etc. also may be present, either in the emulsion or in the particulate solid portion of the blend.

Various types of emulsifying agents are known for emulsions to be used as explosives or in emulsion blend explosives. Whether or not a given emulsifying agent is suitable for use in the emulsion to be incorporated in the blend product of the invention depends on the storage stability of the resulting blends. This can be determined by the previously mentioned lead compression test performed on an all-coarse 50/50 blend (i.e., a blend of 50 percent emulsion and 50 percent AN blasting prills). The previously mentioned Salt Extraction Test also can be used. A preferred emulsifying system is the combination of a fatty acid salt and a fatty acid, which affords good storage stability, as is explained in the aforementioned U.S. Pat. No. 4,555,278. With such a system, the free fatty acid is in solution in an oil, and the oil solution constitutes the continuous emulsion phase. The fatty acid and fatty acid salt, together with the oil, form the carbonaceous fuel.

In making the preferred emulsions, the chosen fatty acid is added to the oil, and the fatty acid salt may be introduced in a preformed state, or it can be produced in situ, e.g., as described in U.S. Pat. No. 4,287,010, from the fatty acid and a base when the oil and an aqueous salt solution are combined to form the emulsion. The fatty acid preferably is a saturated or mono-, di- or tri-unsaturated monocarboxylic acid containing about from 12 to 22 carbon atoms, and the salt preferably is an alkali metal, ammonium, and/or alkylammonium salt of the fatty acid.

In the blend product of the invention, the emulsion is present in mixture with a particulate inorganic oxidizing salt in a weight ratio of about from 20/80 to 70/30 emulsion to particulate oxidizing salt; and at least about 15, and preferably at least about 20, percent by weight of the particulate oxidizing salt is comprised of particles which are smaller than 297 micrometers, i.e., at least about 15, and preferably at least about 20, percent "fines". While the emulsion can be blended with a particulate oxidizing salt that is composed substantially of all fines, i.e., so as to produce a blend containing about from 30 to 80 percent fines, based on total blend weight, it is often preferred to use fines in combination with coarser particles, i.e., particles larger than 297 micrometers. Most preferably, a coarse component is present in which some of the particles therein, generally at least about 15 percent by weight of the particulate inorganic oxidizing salt, are larger than 420 micrometers, e.g., are AN or ANFO prills.

In blends of from about 20/80 up to 40/60 percent emulsion to oxidizing salt particles, by weight, it is preferred that the particulate salt contain about from 20 to 70 percent fines by weight (giving a fines content of about from 12 to 56 percent, based on total blend weight). Optimum results, considered mainly in terms of improved water resistance, are obtained when the particulate salt in these blends contains about from 30 to 60 percent fines by weight (giving a fines content of about from 18 to 48 percent, based on total blend weight).

A major benefit of the fines/coarse combination in blends containing larger amounts of emulsion, i.e., 40 percent or more by weight, results from the better distribution of the solid particles in the blend, and in such blends a fines/coarse weight ratio larger than about 34/66 will be selected more on the basis of other desired properties, e.g., sensitivity to initiation, detonation velocity, etc, although some additional improvement in water resistance also is achieved.

That the addition of solid fines to certain emulsion blends does not cause blend destabilization owing to the higher surface area of the fines, and actually can bring about an increase in the water resistance of such blends, is an unexpected discovery. The following discussion is presented to provide a more specific understanding of the benefits achievable by fines addition, as related, for example, to the emulsion content of the blend. The discussion should be understood as not intended to limit the present invention on the basis of any theoretical considerations found therein.

The particulate inorganic oxidizing salt in emulsion blend explosives, e.g., those described in the aforementioned U.S. Pat. No. 4,555,278, usually consists of porous AN prills. It has been found that when fines are substituted for some of these prills in the previously described storage-stable emulsion blend explosives, a significant improvement in the blends' water resistance begins to become apparent when the fines content of the particulate salt portion of the blend attains a level of about 15 percent, provided that the emulsion content of the blend is about 20 percent. At this emulsion level and up to a level somewhere in the 30–40 percent range, the blends appear to behave as if they are "emulsion-deficient", i.e., as if they contain insufficient emulsion to cover the particulate inorganic oxidizing salt. In this case, an "all-fines" particulate solid is more desirable than one in which no fines are present, but the improvement in water resistance, in the case of emulsion-deficient blends, goes through an optimum in the fines range of about from 30 to 60 percent (based on the weight of total particulate solid), and other properties such as blend density and flowability follow the same trend.

When larger amounts of emulsion are present in the blends, e.g., 40 percent or more, the blends appear to behave as if they are "emulsion-sufficient", i.e., as if they contain sufficient emulsion to cover the particulate inorganic oxidizing salt. In this case, the water resistance continues to increase with increasing fines content, but the increase moderates significantly when the fines/coarse percent weight ratio exceeds about 34/66. Blend density appears to level off also. However, a fines content of about from 34 to 100 percent, based on particulate solid weight, in the emulsion-sufficient blends may be very useful in affording a product which has not only improved water resistance but also a higher degree of sensitivity. The addition of large amounts of fines in these products permits the attainment of increased sensitivity and detonation velocity without the concomitant undesirable decrease in density which occurs with the use of the common physical sensitizers such as microballoons.

The inorganic oxidizing salt which forms the particulate solid portion of the blend product of the invention can be ammonium nitrate (AN), ammonium perchlorate, an alkali metal nitrate, e.g., sodium nitrate (SN), an alkali metal perchlorate, an alkaline-earth metal nitrate, e.g., calcium nitrate (CN), or an alkaline-earth metal perchlorate, or any combination of two or more such nitrates, in the form of granules or prills, or prills lightly coated with fuel oil, e.g., the well-known "ANFO", in which the usual AN/FO ratio is about 94/6, and/or coated according to the method described in the aforementioned U.S. Pat. No. 4,555,278. For a coarse component, AN prills and ANFO are preferred. The AN prills can be the blasting prills commonly used in explosives, or agricultural or fertilizer prills. Blasting prills are usually less dense and more porous than fertilizer prills. When only fertilizer prills are used, blends containing at least about 25 percent emulsion and higher fines levels, e.g., at least about 25 percent, based on total solid particulate weight, may be required to achieve a desired sensitivity.

The fines component can be ground-up AN prills, or an inorganic perchlorate, such as ammonium or an alkali metal perchlorate, or a combination of AN and a perchlorate. Regardless of the particular salts(s) used, sufficient fuel, preferably oil, should be mixed therewith, or incorporated into the emulsion, as described previously, to produce an essentially oxygen-balanced blend. The use of less porous fines such as SN fines may be advantageous in terms of affording a more easily pumpable blend because greater fluidity results owing to (a) less absorption of the oil required for oxygen-balancing purposes (relative to the amount of oil absorbed by porous AN fines), and (b) the larger amount of oil needed to oxygen-balance an SN-containing blend.

The fines useful in this invention can be produced in any one of a variety of standard grinding mills. For example, it may be advantageous to utilize existing hammermill facilities found in ANFO plants and used ordinarily to grind ammonium nitrate prills to ANFO-HD dimensions. In grinding the prills, precautions should be taken to avoid contamination for reasons of both safety and performance. When ammonium nitrate prills are ground, sufficient precautions should be taken to minimize exposure to water in any form because water is known to lead to prill degradation. The degree of grinding will depend on the intended final use, i.e., the level of fines desired in the final product. This means, of course, that the particulate inorganic oxidizing salt can be ground directly on a hammermill so that about 15% of it has dimensions smaller than 297 micrometers. Alternatively, the prills can be ground so that essentially all is smaller than 297 micrometers. As previously stated, either can be used directly in a blend or in the latter case the essentially all-fines material can be mixed with ammonium nitrate prills to give the desired fines concentration level in a mixture of coarse and fines particles. The specifics of the grinding conditions are known to those skilled in the art.

The fines per se and their mixtures with coarser particles can easily be characterized by standard sieving techniques and a particle size distribution determined.

The emulsion blend explosives described in the following examples were prepared as follows:

a. The Emulsion

Emulsions of the following formulations were made by the method described in Example 1 of U.S. Pat. No. 4,287,010, except that the glass microballoons and the fly ash were omitted:

| | Emulsion (a) % | Emulsion (b) % |
|---|---|---|
| Ammonium Nitrate (dissolved) | 70.9 | 75.8 |
| Water | 15.6 | 16.6 |
| Oil | 7.6 | 4.3 |
| Oleic Acid | 3.8 | 2.1 |
| Sodium Hydroxide (50% aq. soln.) | 2.1 | 1.2 |

The percentages given for oleic acid and the sodium hydroxide solution represent the proportions used to make an oleate salt emulsifier in situ.

b. The Emulsion Blend

Blends of emulsions (a) and (b) with solid particulate AN were made by two methods. According to one method (referred to herein as "lab method"), the emulsion was added to the bowl of a Hobart Model C-100 mixer (9.6-liter capacity), chosen amounts of crushed and, where needed, whole AN prills were added, and the emulsion and solids were mixed for 4 minutes at about 60 rpm. When oil needed to be added to oxygen-balance the blend, the oil was added before the AN, and the emulsion and oil were mixed for two minutes. In the second method, i.e., the cement-mixer method, the prills (crushed and, where required, whole) were added to a 45-kg capacity cement mixer, set at its lowest possible angle. After the addition of the emulsion, the solids and emulsion were mixed at the lowest speed setting for good tumbling action. Oil, if needed, was added to, and mixed with, the AN before the emulsion was added.

c. Particulate AN

Four different fines/coarse combinations were used. AN Product I was obtained by grinding AN blasting prills, and AN Products II-IV were blends of crushed and whole AN prills (obtained from two different suppliers) typical of those attained in ANFO-HD production, no oil having been added to these products per se. The screen analyses of the four products were as follows:

| | AN Product I | II | III | IV | |
|---|---|---|---|---|---|
| % Held on 50*(>297μ) = coarse | 14.0 | 85.5 | 66.2 | 62.5 | |
| % Through/held 50/100* (<297μ,>149μ) | 27.9 | 7.6 | 32.5 | 19.5 | fines |
| % Through/held 100/140* (<149μ,>105μ) | 14.4 | 2.4 | 0.65 | 7.35 | fines |
| % Through/held 140/200* (<105μ,>74μ) | 3.5 | 0.2 | 0.05 | 5.8 | fines |
| % Through/held 200/325* (<74μ,>44μ) | 27.6 | 3.2 | 0 | 3.7 | fines |
| % Through 325* (<44μ) | 12.6 | 1.1 | 1.05 | 1.15 | fines |

*U.S. Sieve Designations

EXAMPLES 1-12

Blends were prepared by the lab method described above, using the Product I ground AN prills, alone or together with whole AN blasting prills (larger than 420 micrometers) in varying proportions. The blends were evaluated for water resistance and shelf life. Water resistance was estimated by the following salt extraction test:

One hundred grams of water and then 100 g of the blend were weighed into a 237-milliliter, wide-mouth glass jar (10.8 cm high × 5.1 cm in diameter). The sealed jar was placed for 15 minutes on a ball mill having a roller speed of 260 rpm. Fifty milliliters of the aqueous layer was then weighed. The increase in the weight of the water is due to the amount of ammonium nitrate (particulate and in the emulsion's aqueous phase) that has been extracted from the blend, larger amounts denoting poorer blend water resistance. In this test, the difference in the weight of 50 milliliters of water before and after the described rotation is the weight of one-half of the total amount of salt extracted because only one-half to the water used was weighed. The percent salt extracted was calculated as follows:

$$\% \text{ salt extracted} = \frac{\text{wt. 50 ml } H_2O \text{ after extraction} - \text{wt. 50 ml } H_2O}{\text{0.5 total wt. of salt in 100 g blend}} \times 100$$

(The total weight of salt in 100 grams of the blend is the weight of the ammonium nitrate in the emulsion's dispersed aqueous phase plus the weight of the particulate AN in the blend.)

The Salt Extraction Test was designed to provide a meaningful estimate of an emulsion blend's resistance to deterioration by water under conditions commonly encountered in field practice. In the field, blends may be pumped or augured into water-containing holes. In some instances, running as well as stagnant water may be encountered in the wet holes. The test, with its rolling action on the water and the emulsion blend, simulates the flowing conditions which may be encountered in boreholes during loading.

Shelf life was evaluated on the basis of the blend's lead block compression after several days' storage. The explosive product was placed in a cylindrical 0.95-liter paper cup (16.5 cm high × 8.73 cm internal diameter), and packed to its maximum bulk density by tapping the cup on a supporting surface. The cup was then placed on a 1.9-cm-thick × 10.8-cm square steel plate, which in turn was positioned on a lead cylinder 10.2 cm high × 6.2 cm in diameter. The lead cylinder was then placed on a steel plate similar to the one above it. The product was initiated from the cup's open top, the size of the initiator used varying with the sensitivity of the blend. The resulting reduction in the height of the lead cylinder was measured.

The results are shown in Table I.

TABLE I

| Example No. | Control Expt. No. | Blend Composition: Emulsion* % | Coarse AN** % | AN Fines** % | Added Fuel Oil | Water Resistance: Salt Extracted % | Lead Block Test: Compression (cm) | Initiator*** | Age When Tested (days) |
|---|---|---|---|---|---|---|---|---|---|
| 1 | | 50 | 41.4 | 8.6 | 0 | 2.3 | 4.29 | WG | 7 |
| 2 | | 50 | 24.2 | 25.8 | 0 | 0.4 | 5.72 | WG | 7 |
| 3 | | 50 | 7.0 | 43.0 | 0 | 0.22 | 4.12 | ½ WG | 7 |
| | A | 50 | 50 | 0 | 0 | 3.4 | 5.08 | WG | 7 |
| | B | 50 | 47 | 0 | 3.0 | 10.6 | 0.15 | 100 g Flex | 6 |
| | C | 50 | 26.8 | 20.2 | 3.0 | 9.9 | 0.15 | 100 g Flex | 6 |
| 4 | | 40 | 50.4 | 8.6 | 1.0 | 4.76 | 4.78 | WG | 9 |
| 5 | | 40 | 24.6 | 34.4 | 1.0 | 1.87 | 4.29 | ½ WG | 9 |
| 6 | | 40 | 8.3 | 50.7 | 1.0 | 1.34 | 4.45 | ½ WG | 9 |
| | D | 40 | 59 | 0 | 1.0 | 10.13 | 4.45 | WG | 9 |
| | E | 40 | 56.4 | 0 | 3.6 | 11.1 | 0.15 | 100 g Flex | 6 |
| | F | 40 | 32.1 | 24.3 | 3.6 | 16.5 | 0.15 | 100 g Flex | 6 |
| 7 | | 30 | 53.4 | 14.6 | 2.0 | 6.21 | 4.14 | WG | 9 |
| 8 | | 30 | 24.1 | 43.9 | 2.0 | 4.61 | 5.23 | WG | 9 |
| 9 | | 30 | 9.5 | 58.5 | 2.0 | 1.54 | 4.93 | WG | 9 |
| | G | 30 | 68 | 0 | 2.0 | 14.3 | 4.29 | UA | 9 |
| | H | 30 | 65.8 | 0 | 4.2 | 21.6 | 4.29 | 80 g Flex | 6 |
| | I | 30 | 37.5 | 28.3 | 4.2 | 22.6 | 0.15 | 100 g Flex | 6 |
| 10 | | 25 | 59.6 | 12.4 | 3.0 | 14.02 | 5.56 | 40 g Flex | 7 |
| 11 | | 25 | 34.8 | 37.2 | 3.0 | 9.05 | 4.29 | WG | 7 |
| 12 | | 25 | 10.1 | 61.9 | 3.0 | 4.16 | 5.23 | 40 g Flex | 7 |
| | J | 25 | 72 | 0 | 3.0 | 18.27 | 5.08 | ½ WG | 7 |
| | K | 25 | 70.5 | 0 | 4.5 | 23.9 | 4.60 | 40 g Flex | 6 |
| | L | 25 | 40.2 | 30.3 | 4.5 | 24.0 | 3.02 | 100 g Flex | 6 |
| | M | 15 | 46.6 | 34.4 | 4.0 | 17.3 | 3.81 | ½ WG | 9 |
| | N | 15 | 81.0 | 0 | 4.0 | 20.9 | 4.29 | ½ WG | 9 |

*Emulsion (a) in Examples 1–12 and Control Expts. A, D, G, J, M, and N. Blends in Control Expts. B, C, E, F, H, I, K, and L were made with an emulsion prepared according to U.S. Pat. No. 3,447,978, using 0.5% sorbitan mono-oleate as the emulsifying agent. Neither emulsion was sensitized per se.

**Blends containing fines were made from AN Product I plus whole AN blasting prills sufficient to provide the indicated % particles larger than 297μ (coarse) and % particles smaller than 297μ (fines). The whole prills were used to make the blends wherein the coarse/fines ratio was greater than 14/86. Blends containing no fines were made from whole AN blasting prills.

***WG = 20 g "Detaprime" (tubular extruded mixture of 75% PETN in elastomeric binder)

½ WG = ½ 20 g "Detaprime"

UA = 6 g "Detaprime"

Flex = 3.8 cm-diameter cylinder of 75% PETN in elastomeric binder

Table I shows that emulsion blends with all-coarse AN containing 25–50 percent emulsion and which are storage-stable as defined herein (blends made in Control Expts. A, D, G, and J) have their water resistance improved by the addition of AN fines to the blends with no deleterious effect on shelf life (Examples 1, 2, and 3 vs. Control Expt. A; Examples 4, 5, and 6 vs. Control Expt. D; Examples 7, 8, and 9 vs. Control Expt. G; and Examples 10, 11, and 12 vs. Control Expt. J). This table also shows that blends which contain 15 percent emulsion, and those which are not storage-stable, as judged from the lead compression test, do not show any significant improvement in water resistance, and generally are worsened, by the addition of fines thereto (Control Expts. B vs. C, E vs. F, H vs. I, K vs. L, and M vs. N).

EXAMPLES 13 and 14

50/50 Blends of Emulsion (a) with solid particulate AN were made by the cement mixer method, packaged in polyethylene chub cartridges, and tested periodically for shelf life by attempting to detonate them unconfined. The solid particulate AN consisted of AN product I and whole AN blasting prills in amount to provide a coarse AN (larger than 297μ) content in the blend of 32.8 percent, and a fines content in the blend of 17.2 percent (65.6 percent coarse AN and 34.4 percent fines, based on the particulate component). The cartridges were initiated unconfined by means of a 0.45-kg cast primer known as an HDP-1 primer.

| Example No. | Control Expt. No. | Coarse AN % | AN Fines % | Age/VOD days/m/sec | Age/VOD months/m/sec |
|---|---|---|---|---|---|
| 13* | | 32.8 | 17.2 | 5/3463 | 1.75/3228 |
| | O* | 50 | 0 | 5/3000 | 1.5/2959 |
| 14** | | 32.8 | 17.2 | 5/3552 | 2.5/3419 |
| | P** | 50 | 0 | 5/3300 | 2.5/3019 |

*6.8 kg cartridge 10.16 cm in diameter

**13.6 kg cartridge 12.7 cm in diameter

EXAMPLES 15–18

50/50 Blends of Emulsion (a) and AN products I, II, III, and IV were made by the lab method. No whole AN prills were added. The products had the following properties:

| Example No. | AN Product | Fines* % | Salt Extracted % | Min. Initiator** to Produce Lead Block Compression ≧3.8 cm after 7 days |
|---|---|---|---|---|
| 15 | I | 86 | 0.1 | ½ UA |
| 16 | II | 14.5 | 0.9 | UA |
| 17 | III | 33.8 | 2.1 | ½ UA |
| 18 | IV | 37.5 | 1.0 | ½ UA |

*Based on total weight of particulate AN

**See Table I

The above results indicate the effectiveness of AN fines in improving the water resistance of emulsion blends over a wide range of fines content (compare with Control Expt. A in Table I). The results also show that, with essentially the same fines content (Examples 17 and 18), better water resistance may be achieved with a solid ammonium nitrate product having a more scattered distribution of particle sizes (Product IV vs. Product III).

EXAMPLE 19

A 50/50 emulsion blend was prepared by the cement mixer method, using Emulsion (a), AN Product I, and whole AN blasting prills. Emulsion (a) was per se devoid of a sensitizing amount of dispersed gas bubbles or voids, and contained sufficient oil to oxygen balance the AN dissolved therein as well as the solid AN in the blend. Based on the total weight of the blend, the coarse AN content was 32.8 percent, and the AN fines content 17.2 percent.

When packaged in polyethylene chub cartridges and initiated unconfined by means of a 0.45-kg cast primer, the blend detonated at velocities of 3713, 3432, and 2822 m/sec in diameters of 12.7, 10.2, and 7.6 cm, respectively.

In contrast, a blend made in the same manner from the same emulsion, but containing no fines, gave detonation velocities of 3810, 3350, and 2108 m/sec in diameters of 12.7, 10.2, and 7.6 cm, respectively, only when 5.7 percent by weight of fly ash was included in the formulation. Thus in a given blend, the use of an inorganic oxidizing salt in the form of fines may avoid the need for relatively expensive physical sensitizers in the product.

EXAMPLES 20–22

A series of experiments was performed with 50/50 emulsion/AN blends containing AN fines according to the present invention to show that AN agricultural prills can be substituted for blasting prills therein. Emulsion (b) was blended (lab method) with an AN product made by grinding AN agricultural prills to a size distribution similar to that of AN Product I. Where necessary, the ground product was used together with whole AN agricultural prills, which had a particle density of 1.59 g/cc. The following table shows the results of lead compression tests performed on the 7-day-old blends.

| Example No. | Control Expt. No. | Coarse AN % | AN Fines % | Lead Compression Test: Compression (cm) | Lead Compression Test: Initiator |
|---|---|---|---|---|---|
| 20 | | 7.0 | 43.0 | 5.56 | 40 g Flex** |
| | Q | 50.0* | 0 | 0 | 40 g Flex |
| 21 | | 24.2** | 25.8 | 4.60 | 60 g Flex |
| 22 | | 32.8** | 17.2 | 4.14 | 80 g Flex |

*All agricultural prills
**Prills plus coarse portion of ground product
***See Table I

EXAMPLE 23

A 50/50 blend was made in the cement mixer from emulsion (a) and the solid AN component used in Example 22. The blend was packaged in a 12.7 cm diameter polyethylene chub cartridge weighing 13.6 kg, and its detonation velocity measured in a steel pipe after 7 and 29 days. An HDP-1 initiator was used. The packaged blend detonated at 3504 and 4198 m/sec after 7 and 29 days, respectively. The same blend containing only whole agricultural prills (no fines) detonated at 2102 and 3894 m/sec after 7 and 29 days, respectively.

We claim:

1. In a storage-stable emulsion blend explosive comprising a sensitized blend of inorganic oxidizing salt particles and a water-in-oil emulsion comprising a carbonaceous fuel having compenents which form a continuous emulsion phase, an aqueous solution of an inorganic oxidizing salt forming a discontinuous phase dispersed as discrete droplets within said continuous phase, and an emulsifying agent, the improvement comprising inorganic oxidizing salt particles containing at least about 15 percent by weight of a fines component comprised of inorganic oxidizing salt particles which are smaller than 297 micrometers, the weight ratio of said emulsion to the total inorganic oxidizing salt particles being in the range of about from 20/80 to 70/30.

2. An explosive of claim 1 wherein said fines component is comprised of at least one member selected from the group consisting of nitrates and perchlorates.

3. An explosive of claim 1 wherein said emulsion contains, in its emulsifying system, a salt of a fatty acid, as well as the free fatty acid in solution in an oil, said oil solution forming said continuous emulsion phase, and said fatty acid, said fatty acid salt, and said oil together forming said carbonaceous fuel.

4. An explosive of claim 1 wherein said fines component constitutes substantially the entire amount of inorganic oxidizing salt particles therein.

5. An explosive of claim 4 wherein the percent emulsion in said blend is at least 40.

6. An explosive of claim 5 wherein said fines component is comprised of at least one member selected from the group consisting of nitrates and perchlorates.

7. An explosive of claim 1 wherein said inorganic oxidizing salt particles contain a coarse component comprised of particles which are larger than 297 micrometers.

8. An explosive of claim 7 wherein said fines component is comprised of at least one member selected from the group consisting of nitrates and perchlorates.

9. An explosive of claim 8 wherein said fines component contains sodium nitrate.

10. An explosive of claim 8 wherein said coarse and fines components comprise a combination of whole and crushed ammonium nitrate prills, ammonium nitrate-fuel oil prills, or a combination of ammonium nitrate and ammonium nitrate-fuel oil prills.

11. An explosive of claim 10 wherein the percent emulsion in said blend ranges from about 20 up to 40, and the fines content of the whole and crushed prills is about from 30 to 60 percent.

12. An explosive of claim 10 wherein the percent emulsion in said blend is at least 40, and the fines content of the whole and crushed prills is at least about 34 percent.

13. An explosive of claim 7 wherein said coarse component contains particles which are larger than 420 micrometers.

14. An explosive of claim 13 wherein said particles larger than 420 micrometers constitute at least about 15 percent of said inorganic oxidizing salt particles by weight.

15. An explosive of claim 14 wherein said coarse component contains whole ammonium nitrate prills, ammonium nitrate-fuel oil prills, or a combination thereof.

16. An explosive of claim 7 wherein the percent emulsion in said blend ranges from about 20 up to 40 percent.

17. An explosive of claim 16 wherein the inorganic oxidizing salt particles contain about from 20 to 70 percent of said fines component.

18. An explosive of claim 7 wherein the percent emulsion in said blend is at least 40.

19. An explosive of claim 18 wherein the inorganic oxidizing salt particles contain at least 20 percent of said fines component.

20. An explosive of claim 10 wherein said blend is formed from an emulsion that contains a sensitizing amount of dispersed gas bubbles or voids.

21. An explosive of claim 10 wherein said blend is formed from an emulsion that is devoid of a sensitizing amount of dispersed gas bubbles or voids, and said blend is sensitized by air carried into it by prills.

22. An explosive of claim 10 wherein said blend is formed from an emulsion that is devoid of a sensitizing amount of dispersed gas bubbles or voids, and said blend is sensitized by said fines component.

23. An explosive of claim 1 wherein said blend is formed from an emulsion that contains oil in an amount sufficient to oxygen-balance all of said particulate inorganic oxidizing salt.

24. An explosive of claim 1 wherein said blend is formed from (a) an emulsion that contains oil in an amount sufficient to oxygen-balance the inorganic oxidizing salt in said discontinuous emulsion phase and (b) added oil as required to oxygen-balance all, or a portion, of said particulate inorganic oxidizing salt.

25. An explosive of claim 24 wherein said blend is formed from said emulsion and a mixture of whole and crushed AN prills that has been treated with oil.

26. A method of making an emulsion blend explosive of improved water resistance from a storage-stable emulsion blend of about from 30 to 80 percent by weight of inorganic oxidizing salt particles larger than 420 micrometers and about from 70 to 20 percent by weight of a water-in-oil emulsion comprising a carbonaceous fuel having components which form a continuous emulsion phase, an aqueous solution of an inorganic oxidizing salt forming a discontinuous emulsion phase dispersed as discrete droplets within the continuous phase, and an emulsifying agent, said method comprising replacing at least about 15 percent by weight of said particles by inorganic oxidizing salt particles which are smaller than 297 micrometers, said storage-stable emulsion blend from which said explosive of improved water resistance is made being one which, when formed with AN blasting prills to a 3000–3500 poise viscosity in a 50/50 weight ratio, gives a lead compression of at least 3.8 centimeters when initiated with a 40-g initiator after storage for a period of 7 days.

27. A method of claim 26 wherein said emulsion contains, in its emulsifying system, a salt of a fatty acid, as well as the fatty acid in solution in an oil.

* * * * *